US007842873B2

(12) United States Patent
Gerl et al.

(10) Patent No.: US 7,842,873 B2
(45) Date of Patent: Nov. 30, 2010

(54) SPEECH-DRIVEN SELECTION OF AN AUDIO FILE

(75) Inventors: Franz S. Gerl, Neu-Ulm (DE); Daniel Willett, Walluf (DE); Raymond Brueckner, Blaustein (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 372 days.

(21) Appl. No.: 11/674,108

(22) Filed: Feb. 12, 2007

(65) Prior Publication Data

US 2008/0065382 A1 Mar. 13, 2008

(30) Foreign Application Priority Data

Feb. 10, 2006 (EP) ..... 06002752

(51) Int. Cl.
*G10H 1/00* (2006.01)

(52) U.S. Cl. ..... 84/600; 84/609; 704/239; 704/243

(58) Field of Classification Search ..... 84/600–602, 84/609, 649; 700/94; 704/231–257
See application file for complete search history.

(56) References Cited

U.S. PATENT DOCUMENTS

| | | | | |
|---|---|---|---|---|
| 5,521,324 | A * | 5/1996 | Dannenberg et al. | 84/612 |
| 6,476,306 | B2 * | 11/2002 | Huopaniemi et al. | 84/609 |
| 6,931,377 | B1 * | 8/2005 | Seya | 704/277 |
| 7,488,886 | B2 * | 2/2009 | Kemp | 84/609 |
| 2002/0038597 | A1 * | 4/2002 | Huopaniemi et al. | 84/609 |
| 2003/0187649 | A1 | 10/2003 | Logan et al. | |
| 2003/0233929 | A1 * | 12/2003 | Agnihotri | 84/609 |
| 2004/0054541 | A1 | 3/2004 | Kryze et al. | 704/275 |
| 2004/0234250 | A1 * | 11/2004 | Cote et al. | 386/96 |
| 2005/0038814 | A1 * | 2/2005 | Iyengar et al. | 707/104.1 |
| 2005/0159953 | A1 | 7/2005 | Seide et al. | |
| 2005/0241465 | A1 * | 11/2005 | Goto | 84/616 |
| 2006/0112812 | A1 * | 6/2006 | Venkataraman et al. | 84/616 |
| 2006/0210157 | A1 * | 9/2006 | Agnihotri et al. | 382/173 |
| 2007/0078708 | A1 * | 4/2007 | Yu et al. | 705/14 |
| 2007/0131094 | A1 * | 6/2007 | Kemp | 84/609 |
| 2008/0005091 | A1 * | 1/2008 | Lawler et al. | 707/4 |
| 2008/0005105 | A1 * | 1/2008 | Lawler et al. | 707/6 |

(Continued)

FOREIGN PATENT DOCUMENTS

| | | |
|---|---|---|
| EP | 1616275 | 1/2006 |
| WO | WO 01/58165 | 8/2001 |

OTHER PUBLICATIONS

Xi Shao, Namunu C. Maddage, Changsheng Xu and Mohan S. Kankanhalli; Automatic Music Summarization Based on Music Structure Analysis; 2005; pp. 1169-1172.

(Continued)

*Primary Examiner*—David S. Warren
(74) *Attorney, Agent, or Firm*—The Eclipse Group LLP

(57) ABSTRACT

A system and method for detecting a refrain in an audio file having vocal components. The method and system includes generating a phonetic transcription of a portion of the audio file, analyzing the phonetic transcription and identifying a vocal segment in the generated phonetic transcription that is repeated frequently. The method and system further relate to the speech-driven selection based on similarity of detected refrain and user input.

13 Claims, 5 Drawing Sheets

U.S. PATENT DOCUMENTS

| | | | | |
|---|---|---|---|---|
| 2008/0065382 | A1* | 3/2008 | Gerl et al. | 704/258 |
| 2008/0209484 | A1* | 8/2008 | Xu | 725/105 |
| 2009/0171938 | A1* | 7/2009 | Levin et al. | 707/5 |
| 2009/0173214 | A1* | 7/2009 | Eom et al. | 84/610 |

OTHER PUBLICATIONS

Chong-kai Wang, Ren-yuan Lyu and Yuang-chin Chiang; An Automatic Singing Transcription System with Multilingual Singing Lyric Recognizer and Robust Melody Tracker; 2003; pp. 1197-1200.

Beth Logan and Stephen Chu; Music Summarization Using Key Phrases; 2000; pp. 749-752.

Wei-Ho Tsai and Hsin-Min Wang; On the Extraction of Vocal-related Information to Facilitate the Management of Popular Music Collections; Jun. 7, 2005; pp. 197-206.

Cardillo, et al.; Phonetic Searching vs. LVCSR: How to Find What You really Want in Audio Archives; International Journal of Speech Technology 5; 9-22, 2002; pp. 9-22.

* cited by examiner

SPEECH-DRIVEN SELECTION OF AN AUDIO FILE

RELATED APPLICATIONS

This application claims priority of European Patent Application Serial Number 06 002 752.1, filed on Feb. 10, 2006, titled SYSTEM FOR A SPEECH-DRIVEN SELECTION OF AN AUDIO FILE AND METHOD THEREFORE, which application is incorporated by reference in this application in its entirety.

BACKGROUND OF THE INVENTION

1. Field of the Invention

This invention relates to a method and system for detecting a refrain in an audio file, a method and system for processing the audio file, and a method and system for a speech-driven selection of the audio file.

2. Related Art

Vehicles typically include audio systems in which audio data or audio files stored on storage media, such as compact disks (CD's) or other memory media, are played. Some times, vehicles also include entertainment systems, which are capable of playing video files, such as DVD's. While driving, the driver should carefully watch the traffic situation around him, and thus a visual interface from the car audio system to the user of the system, who at the same time is the driver, is disadvantageous. Thus, speech-controlled operation of devices incorporated in vehicles is becoming of more desirable.

Besides the safety aspect in cars, speech-driven access to audio archives is becoming desirable for portable or home audio players, too, as archives are rapidly growing and haptic interfaces turn out to be hard to use for the selection of files from long lists.

Recently, the use of media files such as audio or video files, which are available over a centralized commercial database such as ITUNES® from Apple has become very well-known. Additionally, the use of these audio or video files as digitally stored data has become a widely spread phenomenon due to the fact that systems have been developed, which allow the storing of these data files in a compact way using different compression techniques. Furthermore, the copying of music data formerly provided in a compact disc or other storage media has become possible in recent years. Sometimes these digitally stored audio files include metadata, which may be stored in a tag.

The voice-controlled selection of an audio file is a challenging task. First of all, the title of the audio file or the expression a user uses to select a file is often not in the user's native language. Additionally, the audio files stored on different media do not necessarily include a tag in which phonetic or orthographic information about the audio file itself is stored. Even if such tags are present, a speech-driven selection of an audio file often fails due to the fact that the character encodings are unknown, the language of the orthographic labels is unknown, or due to unresolved abbreviations, spelling mistakes, careless use of capital letters and non-Latin characters, etc.

Furthermore, in some cases, the song titles do not represent the most prominent part of a song's refrain. In many such cases a user will, however, not be aware of this circumstance, but will instead utter words of the refrain for selecting the audio file in a speech-driven audio player. Accordingly, a need exists to improve the speech-controlled selection of audio files and help to identify an audio file more easily.

SUMMARY

In an example of one implementation, a method is provided for detecting a refrain in an audio file, which includes vocal components. The method includes generating a phonetic transcription of a major part of the audio file and identifying a vocal segment in the generated phonetic transcription that is repeated at least once. Such identified repeated vocal segment may represent the refrain.

In an example of another implementation, a system is provided for detecting a refrain in an audio file, the audio file including at least vocal components. The system includes a phonetic transcription unit that generates a phonetic transcription of a major part of the audio file. Additionally, the system includes an analyzing unit that identifies vocal segments repeated at least once within the phonetic transcription.

An example of another implementation provides a method for processing an audio file having at least vocal components. The method includes detecting a refrain of the audio file, generating a phonetic or acoustic representation of the refrain, and storing the generated phonetic or acoustic representation together with the audio file.

In an example of another implementation, a system is provided for processing an audio file having at least vocal components. The system includes a detecting unit that detects the refrain of the audio file, a transcription unit that generates a phonetic or acoustic representation of the refrain and a control unit that stores the phonetic or acoustic representation linked to the audio data.

An example of another implementation provides a method of speech-driven selection of an audio file from a plurality of audio files in an audio player, each of the audio files comprising at least vocal components. The method includes (i) detecting a refrain in each of the audio files of the plurality of audio files; (ii) determining phonetic or acoustic representations of at least part of a refrain of each of the audio files; (iii) supplying each of the phonetic or acoustic representations to a speech recognition unit; (iv) comparing the phonetic or acoustic representations to the voice command of the user of the audio player; and (v) selecting an audio file based on the best matching result of the comparison.

In an example of another implementation, a system is provided for a speech-driven selection of an audio file. The system includes (i) a refrain detecting unit that detects the refrain of an audio file; (ii) a transcription unit that generates a phonetic or acoustic representation of the detected refrain; (iii) a speech recognition unit that compares the phonetic or acoustic representation to the voice command of the user selecting the audio file and that determines the best matching result of the comparison; and (iv) a control unit that selects the audio file in accordance with the result of the comparison.

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims.

BRIEF DESCRIPTION OF THE FIGURES

The invention can be better understood by referring to the following figures. The components in the figures are not necessarily to scale, emphasis instead being placed upon illustrating the principles of the invention. In the figures, like reference numerals designate corresponding parts throughout the different views.

DETAILED DESCRIPTION

FIGS. 1-5 illustrate various implementations of methods and systems for detecting a refrain in an audio file and for selecting an audio file based upon the voice command of a user. In general, the title of a song or all expression or phrase that represents a song to a user is extracted from the refrain of the song. In this manner, such expression or phrase may be uttered by the user and utilized in the system or method to select the song from an audio file based upon the detection of the refrain and/or the title, expression or phrase within the refrain of the song.

Figure 1:
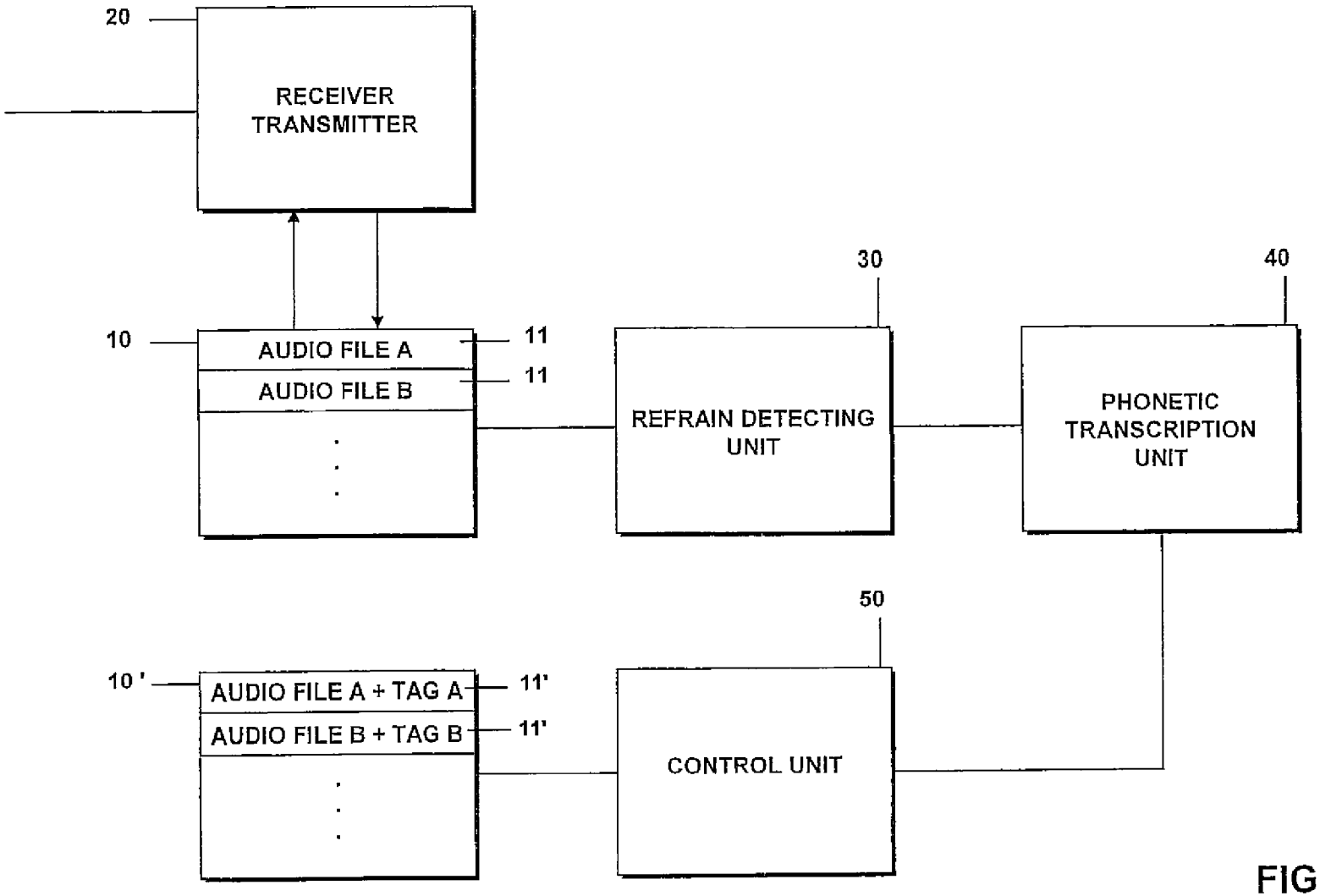
FIG. 1 is a block diagram of an example of an implementation of a system for processing an audio file such that the audio file contains phonetic information about the refrain after the processing.

FIG. 1 is a block diagram of an example of an implementation a system for processing an audio file such that the audio file contains phonetic information about the refrain after processing. In FIG. 1, a system is shown that configures audio data such that it may be identified by a voice command containing all or part of the refrain. By way of example, when a user rips a CD, i.e. performs a digital audio extraction to copy an audio file from the CD, the ripped or copied data normally does not include any additional information that could help to identify the music data. Utilizing the system shown in FIG. 1, music data may be configured in such a way that the music data may be easily selected by a voice-controlled audio system.

As shown in FIG. 1, the system includes a storage medium 10, which includes different audio files 11 having vocal components. By way of a non-limiting example, the audio files may be downloaded from a music server via a transmitter receiver 20 or may be copied from another storage medium so that the audio files may include audio files of different artists and of different genres, be it pop music, jazz, classic, etc. Due to the compact way of storing audio files in formats, such as MP3, AAC, WMA, MOV, etc., the storage medium may include a large number of audio files. To improve the identification of the audio files, the audio files may be transmitted to a refrain detecting unit 30. The refrain detecting unit 30 analyzes the digital data in such a way that the refrain of the music piece may be identified.

As further described below, the refrain detecting unit 30, may detect the refrain of a song in multiple ways. For example, a refrain may be identified by detecting frequently repeating segments in the music signal itself. In another example, a phonetic transcription unit 40 may be utilized to generate a phonetic transcription of all or part of the audio file. In operation, the refrain detecting unit 30 detects similar segments within the resulting string of phonemes. If it is desired that only part or the audio file is to be converted into a phonetic transcription, the refrain may be detected first, utilizing the refrain detecting unit 30, the refrain may then be transmitted to the phonetic transcription unit 40 and generate the phonetic transcription of the refrain. The generated phoneme data may be processed by a control unit 50 such that the data is stored together with the respective audio file as shown in the data base 10'. The data base 10' may be the same data base as the data base 10 of FIG. 1 or may be a different data base. In the implementation shown, data bases 10 and 10' are shown as separate data bases 10 and 10' to emphasize the difference between the audio files before and after processing by the different units 30, 40, and 50.

As shown in connection with data base 10, the generated phoneme data may be stored in the firm of a tag, which may include the phonetic transcription of the refrain. Alternatively, the phoneme data and/or generated transcript of all or part of the refrain, may be stored directly in the audio file itself. The tag may also be stored independently of the audio file and linked to the audio file.

In an example of another implementation, a system for detecting a refrain in the audio file is provided in which the system includes a phonetic transcription unit which automatically generates the phonetic transcription of the audio file. Additionally, the system may include an analyzing unit (not shown) which analyzes the generated phonetic description and identifies the vocal segments of the transcription, which are repeated frequently.

Figure 2:
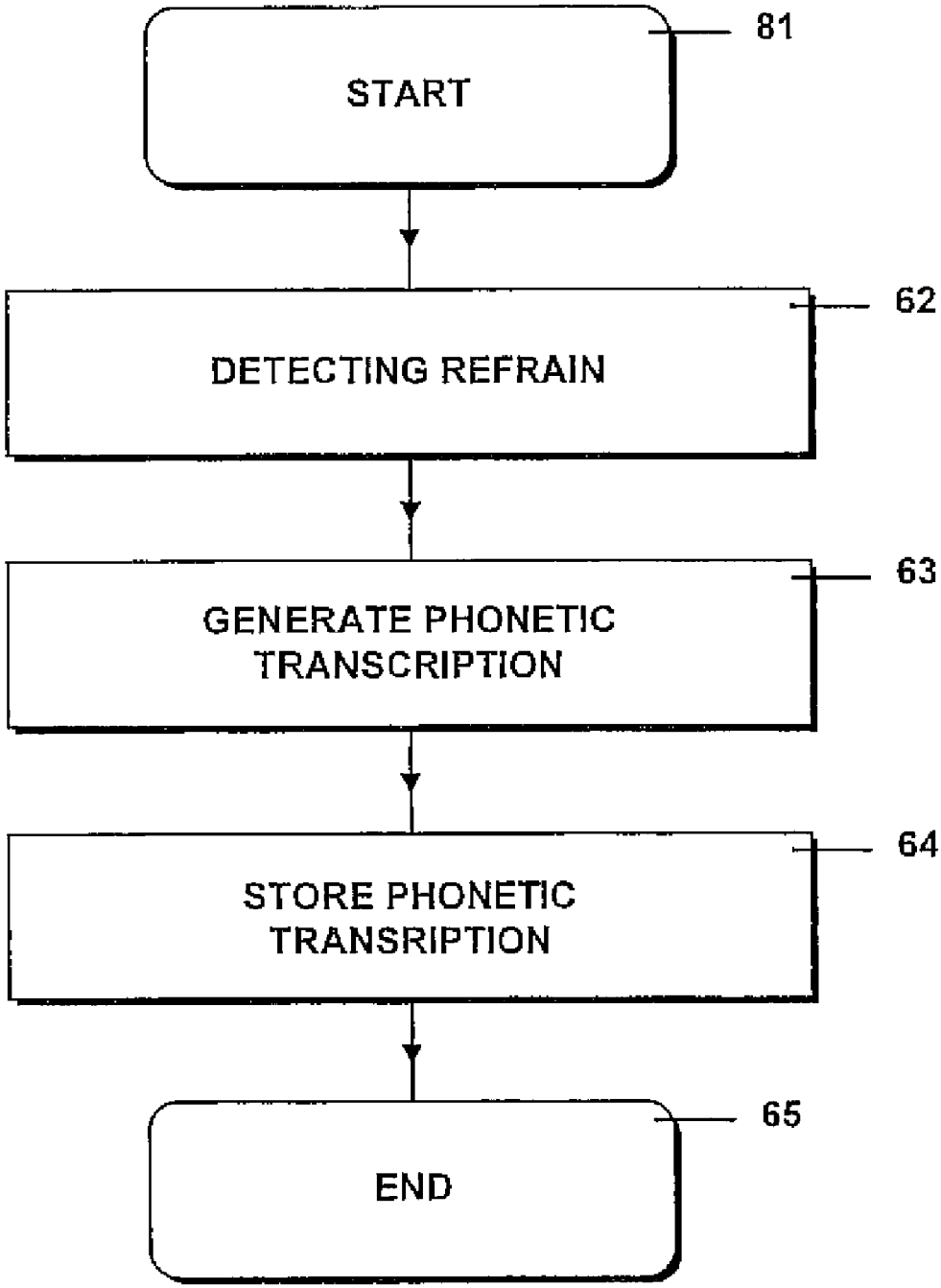
FIG. 2 is a flow chart of an example of an implementation of a method for configuring an audio file to contain phonetic information about the audio file that may be utilized in connection with the system of FIG. 1.

FIG. 2 is a flow chart of an example of an implementation of a method that may be utilized in connection with the system of FIG. 1. The method of FIG. 2 may be utilized for processing audio files so that they may include phonetic information about the refrain of the audio files. In FIG. 2, steps for carrying out the data processing of the audio files are summarized. After starting the process in step 61, the refrain of the song is detected in step 62. The refrain detection may provide multiple possible candidates for the refrain. In step 63, the phonetic transcription of the refrain is generated. In this example, different segments of the song have been identified as the refrain, the phonetic transcription may than be generated for these different segments. In the step 64, the phonetic transcription or phonetic transcriptions are stored in such a way that they are linked to their respective audio file before the process ends in step 65.

As illustrated, FIG. 2 provides for a method of detecting a refrain in an audio file having vocal components. The method includes generating a phonetic transcription of at least part, or major part, of the audio file and analyzing the phonetic transcription to identify one or more frequently repeated vocal segments in the phonetic transcription. A major part of an audio file may constitute at least about 50% of the file and typically from about 70% to about 80% of the file. By frequently repeated vocal segments, it is meant that the vocal segments are repeated at least once and may be repeated two or more times. This frequently repeated vocal segment of the phonetic transcription, which was identified by analyzing the phonetic transcription, typically represents the refrain or at least part of the refrain. The term "refrain" is intended to refer to the line or lines repeated in music often constituting the chorus of a song. As such, the refrain is a repeated portion of lyrics and melody of a song and it frequently constitutes the most recognized aspect of a song.

A phonetic transcription of the refrain helps to identify the audio file and will facilitate a speech-driven selection of an audio file as discussed below. In the present context the term "phonetic transcription" refers to a representation of the pronunciation, i.e., the sounds occurring in human language, in terms of symbols. The phonetic transcription may be not just the phonetic spelling represented in languages such as SAMPA, but it may describe the pronunciation in terms of a string. The term phonetic transcription may be used interchangeably with the terms "acoustic representation" or "phonetic representation". Additionally, the term "audio file" should be understood as also including data of an audio CD or any other digital audio data in the form of a bit stream.

For identifying the vocal segments in the phonetic transcription including the refrain, the method may farther include identifying the parts of the audio file having vocal components. The result of this pre-segmentation will be referred to, from here on, as "vocal part". Additionally, vocal separation may be applied to attenuate the non-vocal components, i.e., the instrumental parts of the audio file. The phonetic transcription may be then generated based upon an audio file in which the vocal components of the file were intensified relative to the non-vocal components. This filtering can, in some instances, help to improve the generated phonetic transcription.

In addition to the analyzed phonetic transcription, other attributes of a song including melody, rhythm, power, harmonics or any combination of these may be used to identify repeated parts of the song. The refrain of a song is usually sung with the same melody, and similar rhythm, power and harmonics. Thus, the use of any one or combination or all of these attributes of a song can, in some instances, reduce the number of combinations which have to be checked for phonetic similarity. For example, the combined evaluation of the generated phonetic data and the melody of the audio file may help to improve the recognition rate of the refrain within a song.

When the phonetic transcription of the audio file is analyzed, it may be decided that a predetermined part of the phonetic transcription represents the refrain if this part of the phonetic transcription may be identified within the audio data at least twice. This comparison of phonetic strings may need to allow for some variations, inasmuch as phonetic strings generated by the recognizer for two different occurrences of the refrain will not necessarily be totally identical. It is further possible to require any pre-selected number of repetitions, to identify the refrain in a vocal audio file.

For detecting the refrain, the whole audio file need not necessarily be analyzed. Accordingly, it is not necessary to generate a phonetic transcription of the complete audio file or the complete vocal part of the audio file when a pre-segmentation approach is utilized. However, to improve the recognition rate for the refrain, a major part of the data (e.g. between 70 and 80% of the data or vocal part) of the audio file should be analyzed to generate the phonetic transcription. While a phonetic transcription may be generated for less than about 50% of the audio file (or the vocal part in case of pre-segmentation), the refrain detection may be less accurate.

As further described below, the method described above may identify the refrain based on a phonetic transcription of the audio file. This detected refrain may be used to identify the audio file allowing for selection of the audio file. In an example of another implementation, a method is provided for processing an audio file having at least vocal components. The method may include detecting the refrain of the audio file, generating a phonetic transcription of the refrain or at least part of the refrain and storing the generated phonetic transcription together with the audio file. This method helps to automatically generate data relating to the audio file, which may be used for identifying the audio file.

The refrain of the audio file may be analyzed as described above, i.e., by generating a phonetic transcription for at least major part of the audio file and identifying the repeating similar segments within the phonetic transcription as the refrain. However, the refrain of the song may also be detected using other detecting methods. Accordingly, it is possible to analyze the audio file itself, as will be further described below, in connection with FIGS. 4 & 5, and not the phonetic transcription to detect the components including voice components, which are repeated frequently. Additionally, it is possible to use both approaches together.

According to another implementation, the refrain may also be detected by analyzing the melody, the harmony or the rhythm of the audio file or any combination of the melody, the harmony and the rhythm of the audio file. This approach to detecting the refrain may be used alone or together with any other method described above.

It might happen that the detected refrain is a very long refrain for certain songs or audio files. These long refrains might not fully represent the song title or the expression the user will intuitively use to select the song in a speech-driven audio player. Therefore, according to another implementation, the method may further include further decomposing the detected refrain and dividing the refrain into different subparts. This process may take into account the prosody, the loudness or the detected vocal pauses or any combination of the prosody, the loudness and the detected vocal pauses. This further decomposition of the refrain may help to identify the important part of the refrain, i.e., the part of the refrain that the user might utter to select said file.

Figure 3:
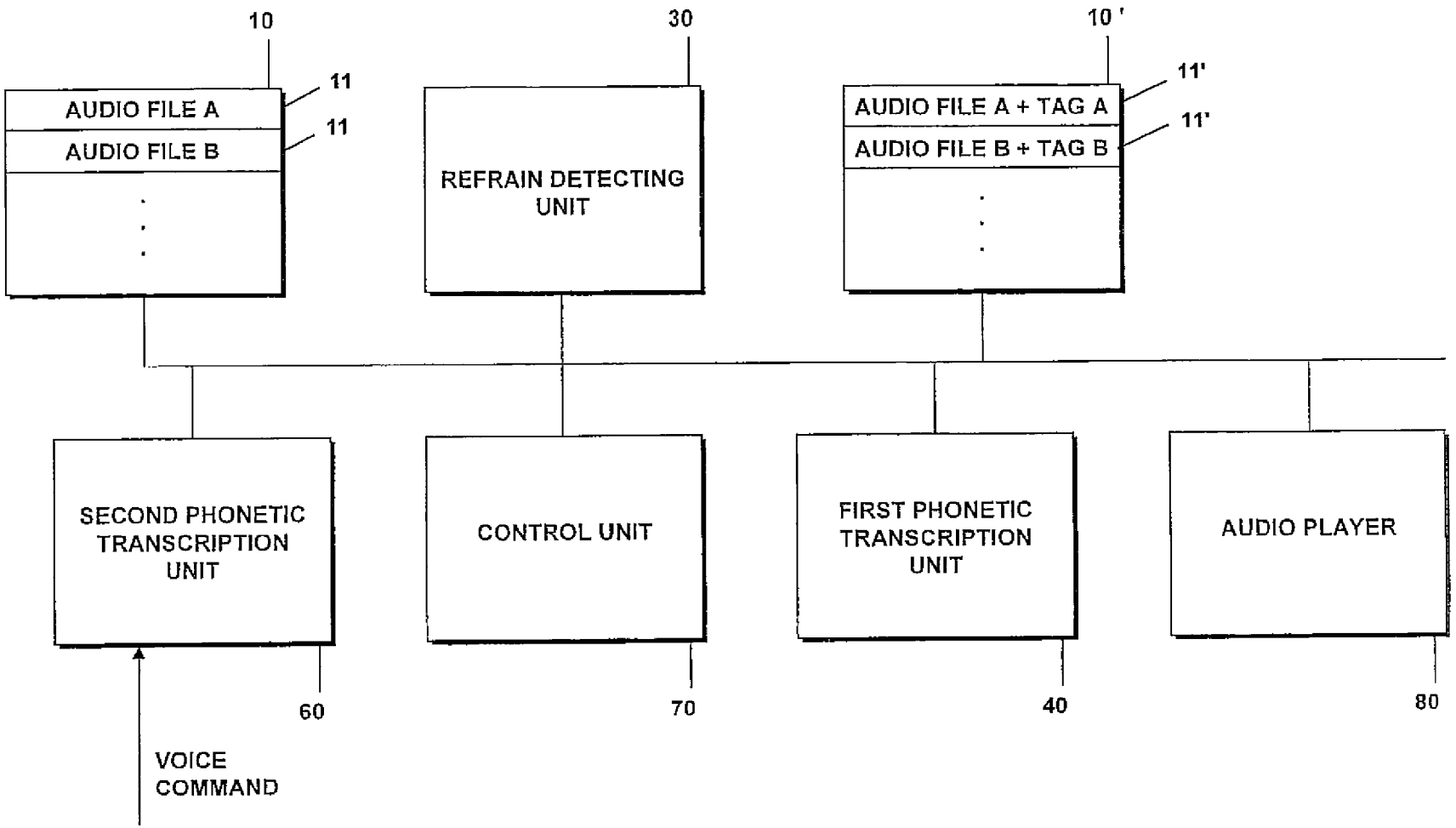
FIG. 3 is a block diagram of another example of an implementation of a voice-controlled system for selection of an audio file.

FIG. 3 is a block diagram of another example of all implementation of a voice-controlled system for selection of an audio file. The system may include the components shown in FIG. 1 that identifying the refrain from the audio file, in addition to component for matching a voice command with the identified refrain. It should be understood that the components shown in FIG. 3 need not be incorporated in one single unit.

The system of FIG. 3 includes the storage medium 10 including the different audio files 11. In the refrain detecting unit 30, the refrain is detected, and may be stored together with the audio files in the data base 10' as described in connection with FIGS. 1 and 2. When the refrain detecting unit 30 has detected the refrain, the refrain is fed to a first phonetic transcription unit for generating the phonetic transcription of the refrain. This transcription includes, to a high probability, the title of the song. The transcription may also, then be stored in database 10' together with the audio files and refrain 11'.

Now, the user wants to select one of the audio files 11' stored in the storage medium 10', the user will utter a voice command. The voice command will be detected and processed by a second phonetic transcription unit 60, which will generate a phoneme string of the voice command. Additionally, a control unit 70 is provided that compares the phonetic data of the first phonetic transcription unit 40 to the phonetic data of the second transcription unit 60. The control unit to than may use the best matching result and will transmit the result to the audio player 80, which then selects from the database 10' the corresponding audio file to be played. As can be seen in the implementation of FIG. 3, a language or title information of the audio file is not necessary for selecting one of the audio files. Additionally, access to a remote music information server (e.g. via the Internet) is also not required for identifying the audio data.

Figure 4:
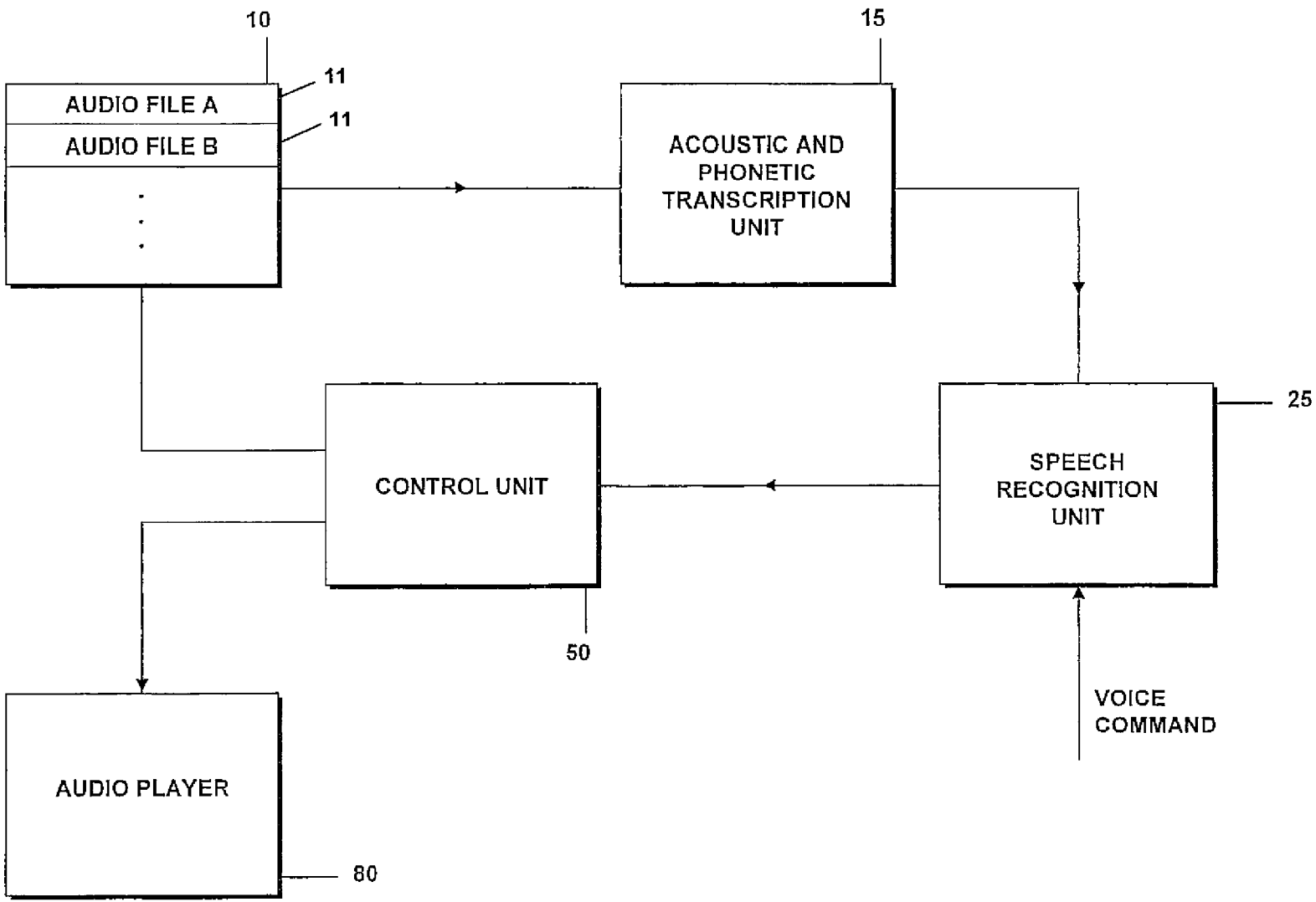
FIG. 4 is a block diagram of yet another example of an implementation of a voice-controlled system for selecting an audio file.

FIG. 4 is a block diagram of another implementation of a voice-controlled system for selecting an audio file. The system includes the storage medium 10 including the different audio files 11. Additionally, an acoustic and phonetic transcription unit 15 is provided that extracts for each file an acoustic and phonetic representation of a major part of the refrain and generates a string representing the refrain. This acoustic string is then fed to a speech recognition unit 25. In the speech recognition unit 25, the acoustic and phonetic representation is used for the statistical model, the speech recognition unit 25 comparing the voice command uttered by the user to the different entries of the speech recognition unit 25 based on a statistical model. The best matching result of the comparison is determined representing the selection the user wanted to make. This information is fed to the control unit 50, which accesses the storage medium 10' including the audio files 11', selects the selected audio file 11' and transmits the audio file 11' to the audio player where the selected audio file may be played.

The different components of the system may be, but need not be incorporated into one single unit. By way of a non-limiting example, the refrain detecting unit (see FIGS. 1 & 3) and the transcription unit 25 may be provided in one computing unit, whereas the speech recognition unit 25 and the control unit 50 responsible for selecting the file might be provided in another unit, e.g. the unit that is incorporated into a vehicle.

Figure 5:
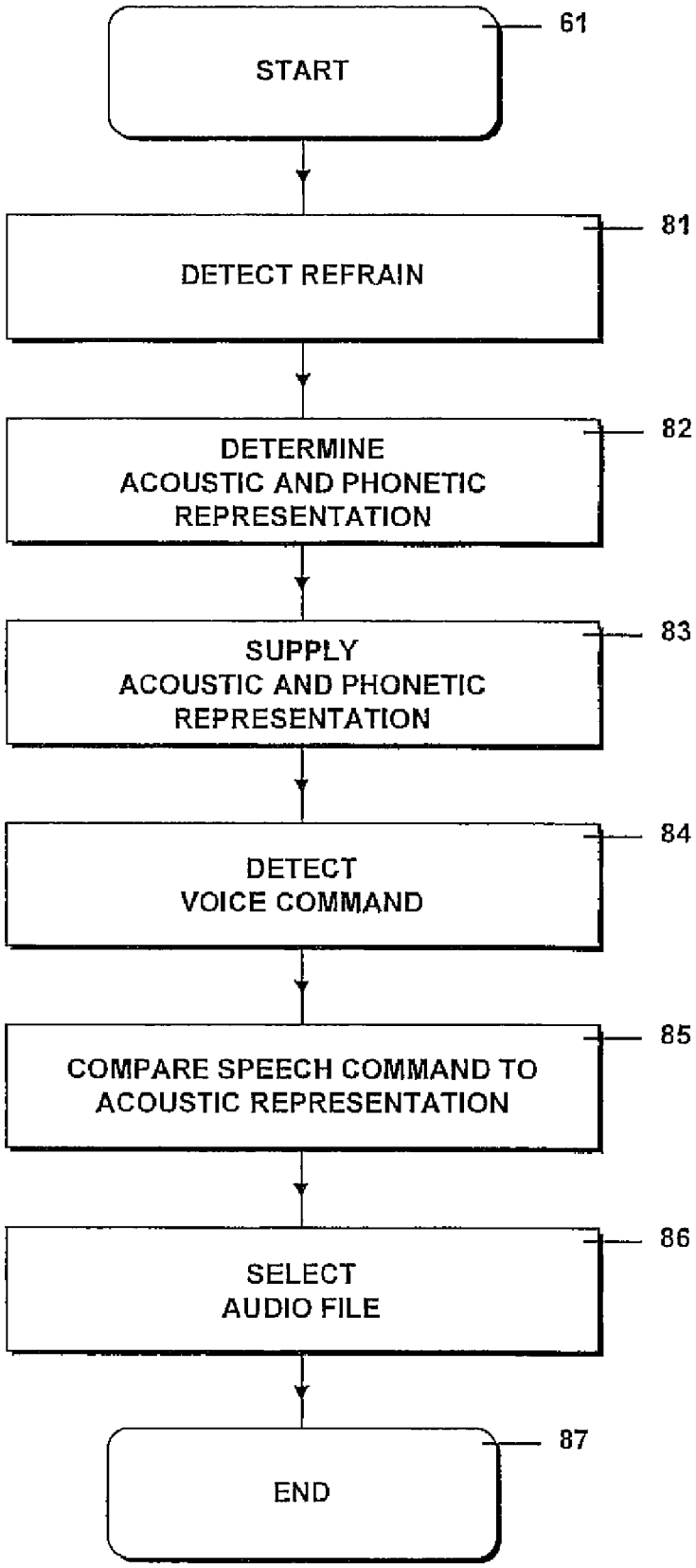
FIG. 5 is a flow chart illustrating one example of a method for selecting an audio file using a voice command that may be utilized by the system illustrated in FIG. 4.

FIG. 5 is a flow chart illustrating one example of a method, that may be utilizing by the system illustrated in FIG. 4 for selecting an audio file by using a voice command. In FIG. 5 steps for carrying out a voice-controlled selection of an audio file are shown. The process starts in step 80. In step 81, the refrain is detected. The detection of the refrain may be carried out in accordance with one of the methods described in connection with FIG. 2. In step 82, the acoustic and phonetic representation representing the refrain is determined and is then supplied to the speech recognition unit 25 in step 83. In step 84, the voice command is detected and also supplied to the speech recognition unit where the speech command is compared to the acoustic/phonetic representation (step 85), the audio file 11 being selected on the basis of the best matching result of the comparison (step 86). The method ends in step 87.

Additionally, in an example of another implementation, a method is provided for a speech-driven selection of an audio file from a plurality of audio files in an audio player. The method can include detecting the refrain of the audio file. Additionally, the method can generate a phonetic or acoustic representation of at least part of the refrain. This representation may be a sequence of symbols or of acoustic features; furthermore it may be the acoustic waveform itself or a statistical model derived from any of the preceding. This representation may then be supplied to a speech recognition unit which compares the representation to the voice command or commands uttered by a user of the audio player. The selection of the audio file may then be based on the best matching result of the comparison of the phonetic or acoustic representations and the voice command. This approach of speech-driven selection of an audio file has the advantage that language information on the title or the title itself is not necessary to identify the audio file. For other approaches a music information server may be accessed in order to identify a song. By automatically generating a phonetic or acoustic representation of the most important part of the audio file, information about the song title and the refrain can be obtained. When the user has in mind a certain song he or she wants to select, he or she will more or less use the pronunciation used within the song. This pronunciation is also reflected in the generated representation of the refrain. The use of this phonetic or acoustic representation of the song's refrain as input may in some instances improve the speech-controlled selection of an audio file.

In general, the use of an acoustic string of the refrain may not by itself provide as definitive an approach for selecting a song from an audio file as the use of a combination of phonetic and acoustic representation. In one such combined approach, the acoustic string may serve as a first approximation that the speech recognition system may then utilize for a more accurate selection of a song from the audio file.

The speech recognition systems may use any one or more pattern matching techniques, which are based upon statistical modeling techniques. Such systems select on the basis of the best pattern matching. Thus a pattern recognition system can be utilized to compare the phonetic transcription of the refrain to the voice commands uttered by the user in the selection of a song from an audio file. Thus, according to one aspect of the invention, the phonetic transcription may be obtained from the audio file itself and the description of the song in the audio file, generated. This description may then be used for pattern matching with the user's voice commands.

The phonetic or acoustic representation of the refrain is a string of characters or acoustic features representing the characteristics of the refrain. The string includes a sequence of characters and such characters of the string may be represented as phonemes, letters or syllables. The voice command of the user may also be converted into another sequence of characters representing the acoustical features of the voice command. A comparison of the acoustic string of the refrain to the sequence of characters of the voice command may be done. In the speech recognition unit the acoustic string of the refrain may be used as all additional possible entry of a list of entries, with which the voice command is compared. A matching step between the voice command and the list of entries including the representations of the refrains may be carried out and the best matching result used. These matching algorithms may be based on statistical models (e.g. hidden Markov model).

The phonetic or acoustic representation may also be integrated into a speech recognizer that recognizes user commands in addition to the representation of the song in the audio file. Normally, the user will utter a representation of the song together with another command expression such as "play" or "delete" etc. The integration of the acoustic representation of the refrain with command components will allow recognition of speech commands such as "play" followed by the user expression identifying the song.

According to one implementation, a phonetic transcription of the refrain may be generated. This phonetic transcription may then be compared to a phoneme string of the voice command of the user of the audio player.

As described above, the refrain may be detected by generating a phonetic transcription of a major part of the audio file and then identifying repeating segments within the transcription. However, it is also possible that the refrain may be detected without generating the phonetic transcription of the whole song as also described above. It is further possible to detect the refrain in other ways and to generate the phonetic or acoustic representation only of the refrain when the latter has been detected. In this case the part of the song for which the transcription has to be generated is much smaller compared to the case when the whole song is converted into a phonetic transcription.

According to another implementation, the detected refrain itself or the generated phonetic transcription of the refrain may be further decomposed.

A possible extension of the speech-driven selection of the audio file may be the combination of the phonetic similarity match with a melodic similarity match of the user utterance and the respective refrain parts. To this end the melody of the refrain may be determined and the melody of the speech command may be determined and the two melodies compared. When one of the audio files is selected, this result of the melody comparison may also be used additionally for determining which audio file the user wants to select. This may lead to a particularly good recognition accuracy in cases where the user manages to also match the melodic structure of the refrain. In this approach the well-known "Query-By-Humming" approach is combined with the phonetic matching approach for an enhanced joint performance.

As stated previously, it may happen that the detected refrain in step 81 is very long. These very long refrains might not fully represent the song title and what the user will intuitively utter to select the song in the speech-driven audio player. Therefore, an additional processing step (not shown) may be provided, which further decomposes the detected refrain. In order to further decompose the refrain, the prosody, loudness, and the detected vocal pauses may be taken into account to detect the song title within the refrain. Depending on the whether the refrain is detected based on the phonetic description or on the signal itself, the long refrain of the audio file may be decomposed itself or farther segmented, or the obtained phonetic representation of the refrain may further be segmented to extract the information the user will probably utter to select an audio file.

The refrain detection and phonetic recognition-based generation of pronunciation strings for the speech-driven selection of audio files and streams may be utilized with one or more additional methods of analyzing the labels (such as MP3 tags) for the generation of pronunciation strings. In this combined application scenario, the refrain-detection based method may be used to generate useful pronunciation alternatives and it may serve as the main source for pronunciation strings for those audio files and stream for which no useful title tag is available. A determination of whether the MP3 tag is part of the refrain may also be utilized to increase the confidence that a particular song may be accessed correctly.

The present invention may also be applied in portable audio players. In this context this portable audio player may include, but need not include all of the hardware facilities to do the complex refrain detecting to generate the phonetic or acoustic representation of the refrain. These two tasks may be performed in some, but not all implementations, by a computing unit such as a desktop computer, whereas the recognition of the speech command and the comparison of the speech command to the phonetic or acoustic representation of the refrain may be performed in the audio player itself.

Furthermore, the phonetic transcription unit used for phonetically annotating the vocals in the music and the phonetic transcription unit used for recognizing the user input do not necessarily have to be identical. The recognition engine for phonetic annotation of the vocals in music might be a dedicated engine specially adapted for this purpose. By way of example, the phonetic transcription unit may have an English grammar data base, inasmuch as most of the pop songs are sung in English, whereas the speech recognition unit may additionally recognize user commands such as "play" in a language other than English. However, the two transcription units should make use of the phonetic representation of the English version of a song in the process of identifying the song.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A method for detecting a refrain in an audio file having vocal components, the method comprising:

generating a phonetic transcription of at least a portion of the audio file;

analyzing the phonetic transcription to detect vocal segments in the generated transcription;

determining if the detected vocal segment is repeated in the generated phonetic transcription at least once; and identifying at least one repeated vocal segment in the generated phonetic transcription to be the refrain.

2. The method of claim 1, further including pre-segmenting the audio file into vocal and non-vocal components.

3. The method of claim 2, further including (i) either or both attenuating the non-vocal components of the audio file and amplifying the vocal components of the audio file and (ii) generating the phonetic transcription based on the resulting audio file.

4. The method of claim 1, further including identifying repeating segments of melody, rhythm, power, and harmonics of the audio file.

5. The method of claim 1, where identifying includes identifying a vocal segment which is repeated at least twice in the phonetic transcription.

6. The method of claim 1, where the phonetic transcription is generated for a majority audio file.

7. A method for processing an audio file having at least vocal components, the method comprising:

detecting a refrain of the audio file by identifying repeated vocal segments in a phonetic transcription of at least a portion of the audio file;

generating either or both a phonetic or acoustic representation of the refrain; and storing the generated phonetic or acoustic representation together with the audio file in memory.

8. The method of claim 7, where detecting the refrain includes detecting vocal segments that are repeated at least once in the audio file.

9. The method of claim 7, where detecting the refrain includes generating a phonetic transcription of a majority of the audio file and identifying repeating similar segments within the phonetic transcription of the audio file.

10. The method of any of claims 9, where detecting the refrain further includes identifying repeating similar segments of melody, harmony or rhythm or any combination thereof in the audio file.

11. The method of claim 7 further including decomposing the detected refrain and further dividing the refrain into subparts based upon prosody, loudness, vocal pauses or combinations thereof, within the refrain.

12. A system for detecting a refrain in an audio file having at least vocal components, the system comprising:

a phonetic transcription unit that generates a phonetic transcription of at least a portion of the audio file;

an analyzing unit that analyzes the generated transcription to detect vocal segments, determines if any detected vocal segment is repeated at least once in the generated transcription, and identifies at least one of the repeated vocal, segments to be the refrain.

13. A system for processing an audio file having at least vocal components, the system comprising:

a transcription unit that generates a phonetic representation of the audio file;

a detecting unit that detects the refrain of the audio file by identifying repeated vocal segments in the phonetic representation of at least a portion of the audio file;

a control unit that stores the phonetic representation linked to the audio data in memory.

* * * * *

UNITED STATES PATENT AND TRADEMARK OFFICE

CERTIFICATE OF CORRECTION

PATENT NO. : 7,842,873 B2
APPLICATION NO. : 11/674108
DATED : November 30, 2010
INVENTOR(S) : Gerl et al.

It is certified that error appears in the above-identified patent and that said Letters Patent is hereby corrected as shown below:

Column 1, lines 30 to 31, "becoming of more desirable" should be changed to --becoming more desirable--
Column 3, lines 31 to 32, "an implemntation a system" should be changed to --an implementation of a system--
Column 4, line 2, "the phonetic transcription unit 40 and generate" should be changed to --the phonetic trancription unit 40 to generate--
Column 4, line 33, "After starting the process in Step 61" should be changed to --After starting the process in step 81--
Column 6, lines 30 to 31, "that identifying the refrain from the audio file, in addition to component for matching" should be changed to --that identify the refrain from the audio file, in addition to components for matching--
Column 6, line 43, "The transcription may also, then" should be changed to --The transcription may also then--
Column 7, line 25, "The process starts in step 80" should be changed to --The process starts in step 61--
Column 10, Claim 10, line 38, "The method of any of claims 9" should be changed to --The method of claim 9--
Column 10, Claim 12, line 54, "vocal, segments" should be changed to --vocal segments--
Column 10, Claim 13, line 61, "the audio file;" should be changed to --the audio file; and--

Signed and Sealed this
Twenty-second Day of March, 2011

David J. Kappos

David J. Kappos
*Director of the United States Patent and Trademark Office*